US007656375B2

(12) United States Patent
Lo et al.

(10) Patent No.: US 7,656,375 B2
(45) Date of Patent: Feb. 2, 2010

(54) IMAGE-PROCESSING DEVICE AND METHOD FOR ENHANCING THE LUMINANCE AND THE IMAGE QUALITY OF DISPLAY PANELS

(75) Inventors: Shin-Tai Lo, Miaoli County (TW); Ruey-Shing Weng, Kaohsiung (TW); Ching-Fu Hsu, Taichung County (TW)

(73) Assignee: Wintek Corporation, Taichung (TW)

( * ) Notice: Subject to any disclaimer, the term of this patent is extended or adjusted under 35 U.S.C. 154(b) by 760 days.

(21) Appl. No.: 11/298,529

(22) Filed: Dec. 12, 2005

(65) Prior Publication Data

US 2006/0146351 A1 Jul. 6, 2006

(30) Foreign Application Priority Data

Dec. 31, 2004 (TW) ..... 93141565 A

(51) Int. Cl.
*G09G 3/36* (2006.01)

(52) U.S. Cl. ..... 345/88; 345/89; 345/102; 382/162

(58) Field of Classification Search ..... 358/1.9; 345/77, 88, 89, 204, 589, 600, 690, 102; 382/162–167; 348/233.1, 643–655
See application file for complete search history.

(56) References Cited

U.S. PATENT DOCUMENTS 5,929,843 A 7/1999 Tanioka
6,724,934 B1 4/2004 Lee et al.
6,961,038 B2 * 11/2005 Yoshinaga et al. ..... 345/88
7,151,517 B2 * 12/2006 Lee ..... 345/88
7,167,150 B2 * 1/2007 Yang et al. ..... 345/89
7,365,722 B2 * 4/2008 Lee ..... 345/88
7,483,011 B2 * 1/2009 Yang et al. ..... 345/88
2004/0046725 A1 * 3/2004 Lee ..... 345/88
2004/0222999 A1 * 11/2004 Choi et al. ..... 345/589
2004/0263456 A1 * 12/2004 Miyachi et al. ..... 345/88
2005/0099426 A1 * 5/2005 Primerano et al. ..... 345/589
2005/0140622 A1 * 6/2005 Lee et al. ..... 345/88

OTHER PUBLICATIONS

Lee et al., 9.2: Implementation of RGBW Color System in TFT-LCDs, SID 04 Digest, 111-113.

* cited by examiner

*Primary Examiner*—Amare Mengistu
*Assistant Examiner*—Dmitriy Bolotin
(74) *Attorney, Agent, or Firm*—Muncy, Geissler, Olds & Lowe, PLLC

(57) ABSTRACT

An image-processing device and method for enhancing the luminance and the image quality of display panels, the device and method includes a color distribution calculating unit which classifies the original image-color data, and then calculates the ratio of the color data in block B2 to all input image-color data. A control-variable generating unit determines the value of the converting-control variable and the value of the backlight luminance-control variable according to the ratio. The converting-control variable will be output to a numerical converting unit so as to convert the original image-color (RGB) data to the new image-color (R'G'B'W') data. The backlight luminance-control variable will be output to a backlight luminance-control unit so as to control the backlight luminance.

6 Claims, 9 Drawing Sheets

IMAGE-PROCESSING DEVICE AND METHOD FOR ENHANCING THE LUMINANCE AND THE IMAGE QUALITY OF DISPLAY PANELS

FIELD OF THE INVENTION

The present invention relates to an image-processing device and method for enhancing the luminance and the image quality of display panels. It is an RGBW-color system, which can display a high-quality color and preserve the image-display quality so as to achieve the goals of increasing luminance double, preserving hues and saturation of colors, and preserving the image-contrast quality concurrently.

BACKGROUND OF THE INVENTION

In recent years, pixels of some panels are composed of four sub-pixels. There are red (R), green (G), blue (B), and white (W) sub-pixels. This RGBW color system can improve the optical efficiency of liquid-crystal displays, where the sub-pixels are arranged as shown in FIGS. 1 and 2.

U.S. Pat. No. 5,929,843 proposed an RGB-to-RGBW image-data converting and processing method as shown in FIG. 3 where R, G, and B are inputs of the image color, and R', G', B' and W' are outputs of the image color, and a minimum-value extractor 11 that chooses the value W' for white light to emit. The algorithm is as follows:

R'=R

G'=G

B'=B

W'=min(R, G, B)

Because image colors red (R), green (G), and blue (B) can be enhanced by the white sub-pixel at the same time, the image luminance can be enhanced by way of the above algorithm. However, the drawback of the algorithm is that the hue and saturation of the original image cannot be preserved. This is caused by the same increment of image colors red (R), green (G), and blue (B), which results in the possibility of changing the ratio of the original image colors red (R), green (G), and blue (B). The change can be understood by the following equation:

$$R:G:B \neq (R'+W'):(G'+W'):(B'+W')$$

Consequently, the hue and saturation of the image are changed resulting from the ratio of the image colors red (R), green (G), and blue (B) changed. The schematic diagram for color space is shown in FIG. 4. For the convenience of comparison, all schematic diagrams for color space are expressed as two dimensions (G) and (R). In FIG. 4, point A represents the original image color (RGB) while point A' represents the resultant image color (R'G'B') after the processing according to the algorithm. By observing FIG. 4, the path for converting point A to point A' does not pass through the original point, although the method proposed by U.S. Pat. No. 5,929,843 enhancing the luminance whereas the hue and saturation of the original image cannot be preserved.

For improving the drawback that although the method proposed by U.S. Pat. No. 5,929,843 enhancing the luminance whereas the hue and saturation of the original image cannot be preserved, U.S. Pat. No. 6,724,934 proposed a new RGB-to-RGBW image-data numerical converting and processing method.

The method used by U.S. Pat. No. 6,724,934 is that classifying in advance according to the numerical relation among red (R), green (G), and blue (B) data of the image pixel. If the data are classified in block B1, as shown in FIG. 5, then $$W'=\min(2\times R, 2\times G, 2\times B)$$

R'=2×R−W'

G'=2×G−W'

B'=2×B−W'

In FIG. 5, point A represents the original image color (RGB) while point A' represents the resultant image color (R'G'B') after the processing according to the algorithm. Converting from point A to point A' not only increases luminance double but also preserves hues and saturation of original colors. This is due to R:G:B=(R'+W'): (G'+W'): (B'+W').

However, if the data are classified in block B2, as shown in FIG. 6, after the numerical relation among red (R), green (G), and blue (B) data of the image pixel is classified, then $$s=1+\{\min(R,G,B)/[\max(R,G,B)-\min(R,G,B)]\}$$

W'=min(s×R, s×G, s×B)

R'=s×R−W'

G'=s×G−W'

B'=s×B−W'

In FIG. 6, point B represents the original image color (RGB) while point B' represents the resultant image color (R'G'B') after the processing according to the algorithm. Converting from point B to point B' not only increases luminance s-times but also preserves hues and saturation of original colors. This is due to R:G:B=(R'+W'):(G'+W'):(B'+W').

Nevertheless, although the method proposed by U.S. Pat. No. 6,724,934 not only increases luminance but also preserves hues and saturation of original colors, the drawback of this algorithm is that the extents of increasing luminance for image colors (RGB) in block B1 and block B2 are different. The extent of increasing luminance for image color in block B1 is 2 while the extent of increasing luminance for image color in block B2 is s (wherein $2 \geqq s \geqq 1$). Especially for those high-luminance and high-saturation images in block B2, of which the extents of increasing luminance are quite different from the extent of increasing luminance for image color in block B1. Because the extents of increasing luminance for those high-luminance and high-saturation images in block B2 approximate to 1 whereas the extent of increasing luminance for image color in block B1 is 2. This results in a too large variation of the simultaneous contrast, and the quality and effect of the image display are degraded. Especially when those images display high-luminance, high-saturation colors, and high-luminance but tend to white color at the same time, the whole image quality is mostly degraded.

Aim to the aforementioned drawbacks, the Samsung Company proposed a paper named 'Implementation of RGBW Color System in TFT-LCDs' in the SID2004 conference. The paper depicted an RGB-to-RGBW image-data numerical converting and processing algorithm of Adaptive White Scaling (AWS).

Please refer to FIG. 7, at the same time of inputting the original image color (RGB), a prescribed luminance-enhancement gain w will be sent to the color distortion analyzer 22. The color distortion analyzer 22 will calculate the color-distortion value e for the image before and after the luminance enhancement according to the inputted original image color (RGB) data and the luminance-enhancement gain w. If the calculated color-distortion value e is greater than the critical value, the w controller 23 will lower the luminance-enhancement gain w, and a new luminance-enhancement gain w will be sent to the color distortion analyzer 22 to recount the color-distortion value e. Based on this loop, the process will continue until the color-distortion value e is smaller than the critical value. The luminance-enhancement gain w is sent to the RGBW converter 21 at this time.

Accordingly, different images have different luminance-enhancement gains w so as to control the color-distortion value e before and after the luminance enhancement for different images to be lower than the critical value, and to restrain the phenomenon of too large variation of the simultaneous contrast before and after the luminance enhancement for some images.

However, the algorithm depicted in the paper has drawbacks as follows:

1. It is necessary to calculate the color-distortion value e before and after the luminance enhancement repeatedly so as to obtain the best luminance-enhancement gain w for the input image data (RGB). The method will spend complicated and much investment of hardware and image calculation.
2. For reducing the color-distortion value e before and after the luminance enhancement, and improving the phenomenon of too large variation of the simultaneous contrast before and after the luminance enhancement, the Adaptive White Scaling (AWS) algorithm is achieved by decreasing the luminance-enhancement gains w. In other words, although the quality of image display contrast is remedied, the effect of luminance enhancement needed by the system cannot be retained. Please refer to FIG. 8, which shows the color space that is displayed when the luminance-enhancement gain w is 2 (w=2). For reducing the color-distortion value e before and after the luminance enhancement, the luminance-enhancement gain w is decreased (as shown in FIG. 9). Even when those images display high-luminance and high-saturation colors and high-luminance but tend to white color, for the purpose of restraining the phenomenon of too large variation of the simultaneous contrast after the luminance enhancement for images, the luminance-enhancement gain w is obligated to be decreased to 1 approximately (as shown in FIG. 10). As a result, the effect of enhancing the color luminance of whole image is almost lost, and it is not able to achieve the goals of increasing luminance, preserving hues and saturation of colors, and preserving the image-contrast quality concurrently.

SUMMARY OF THE INVENTION

Consequently, for solving the abovementioned problems, the main purpose of the current invention is to enhance the luminance of the displayed image color under the condition of retaining the hue and saturation of the original image.

Another purpose of the current invention is to overcome the phenomenon of too large variation of the simultaneous contrast after the luminance enhancement for images so as to enhance the contrast quality and effect of the displayed image after the luminance enhancement.

The present invention has the third purpose that it will not spend complicated and much investment of hardware and image calculation, and it efficiently reduces the operation quantity of the image processing so as to save the investment for circuit hardware.

The fourth purpose of the present invention is that without sacrificing the luminance enhancement, the image-display quality can still be preserved so as to achieve the goals of increasing luminance double, preserving hues and saturation of colors, and preserving the image-contrast quality concurrently.

The present invention is an image-processing device for enhancing the luminance and the image quality of display panels, which is a device and method of RGBW color system for improving the optical efficiency of liquid-crystal displays. The device and method includes a color distribution-calculating unit that classifies the original image-color data. The relation of the colors located in the color space is divided into block B1 and block B2 and then calculates the ratio of the color data in any one of block B1 or block B2 to all input image-color data. A control-variable generating unit determines the value of the converting-control variable and the value of the backlight luminance-control variable according to the ratio. The converting-control variable will be output to a data-converting unit, and the data-converting unit converts the original image-color (RGB) data to the new image-color (R'G'B'W') data according to the converting-control variable. The backlight luminance-control variable will be output to a backlight luminance-control unit so as to control the backlight luminance according to the input backlight luminance-control variable.

BRIEF DESCRIPTION FOR THE DRAWINGS

Figure 1:
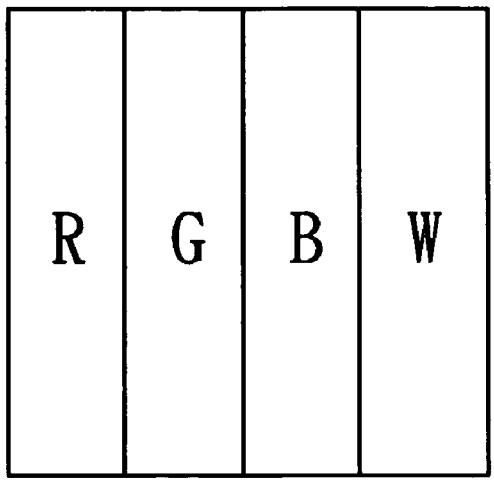
Fig. 1 PRIOR ART
FIG. 1 is the schematic diagram for the prior sub-pixel arrangement for the RGBW.
Figure 2:
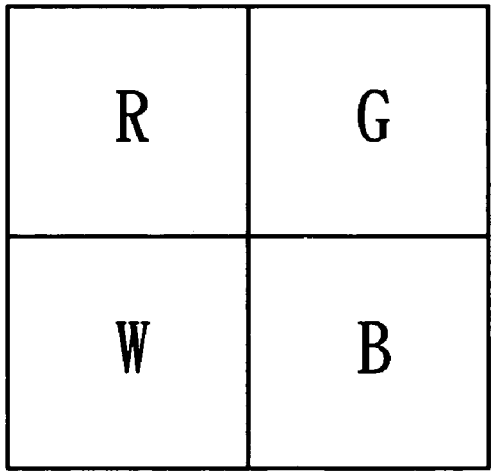
Fig. 2 PRIOR ART
FIG. 2 is another schematic diagram for the prior sub-pixel arrangement for the RGBW.
Figure 3:
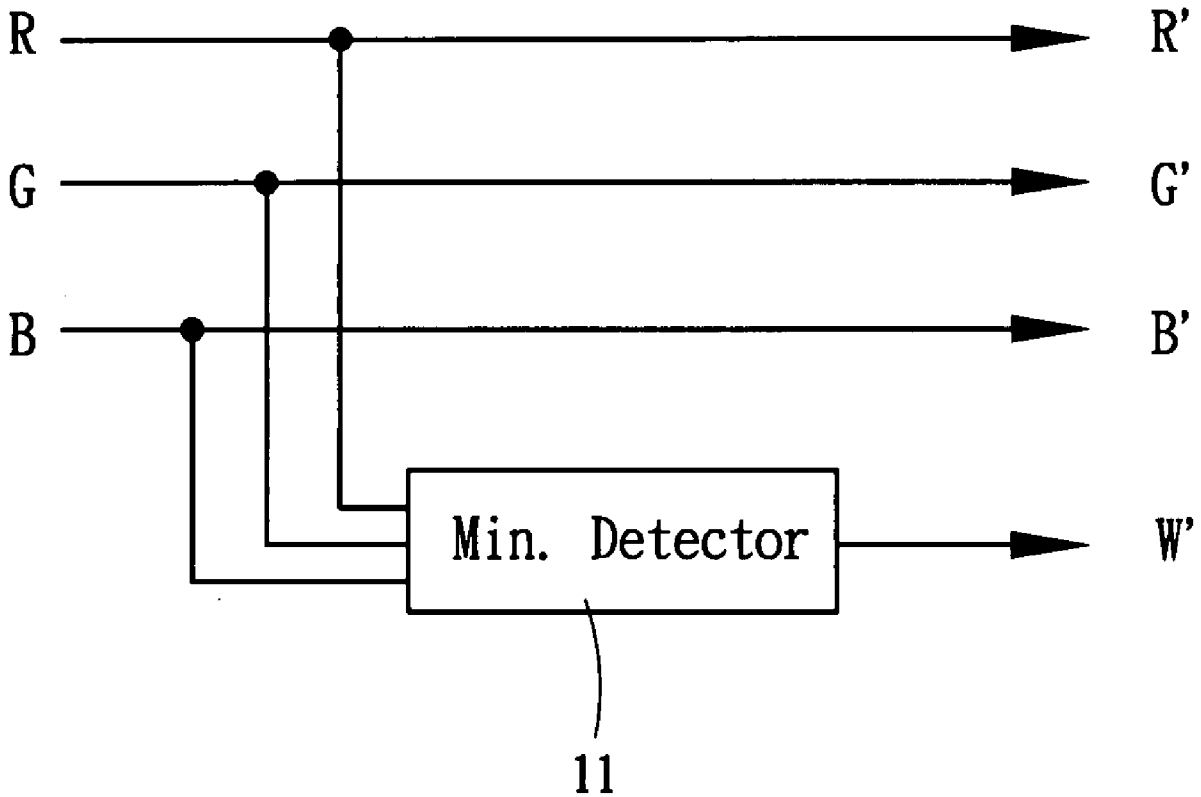
Fig. 3 PRIOR ART

FIG. 3 is the schematic diagram for the image-processing method of U.S. Pat. No. 5,929,843.

Figure 4:
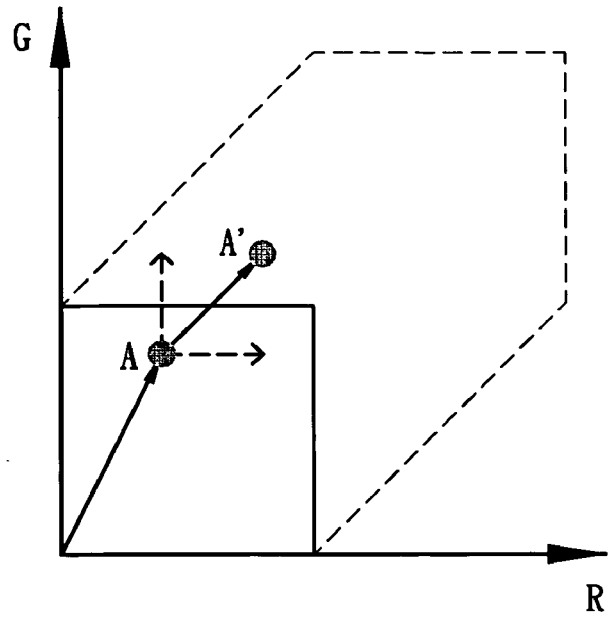
Fig . 4 PRIOR ART

FIG. 4 is the schematic diagram for the color space of U.S. Pat. No. 5,929,843.

Figure 5:
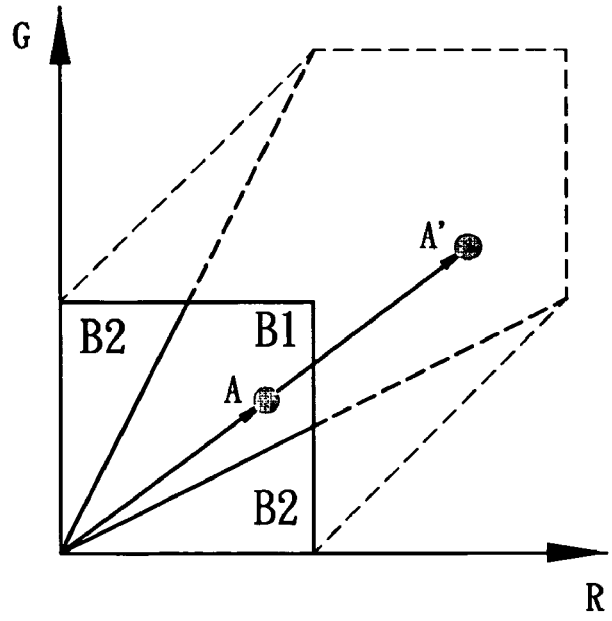
Fig . 5 PRIOR ART

FIG. 5 is the schematic diagram for the color space of U.S. Pat. No. 6,724,934. (The data are classified block B1.)

Figure 6:
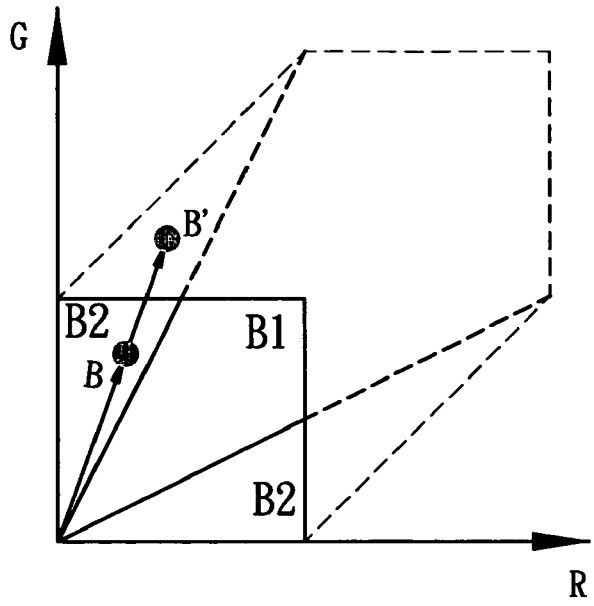
Fig . 6 PRIOR ART

FIG. 6 is the schematic diagram for the color space of U.S. Pat. No. 6,724,934. (The data are classified block B2.)

Figure 7:
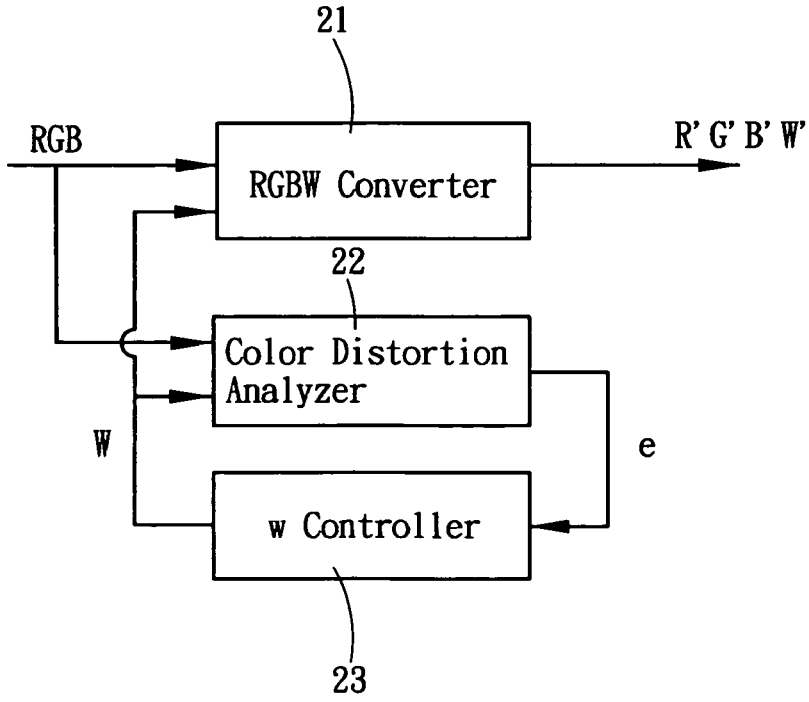
Fig . 7 PRIOR ART

FIG. 7 is the schematic diagram for the image-data numerical converting and processing proposed by the Samsung Company.

Figure 8:
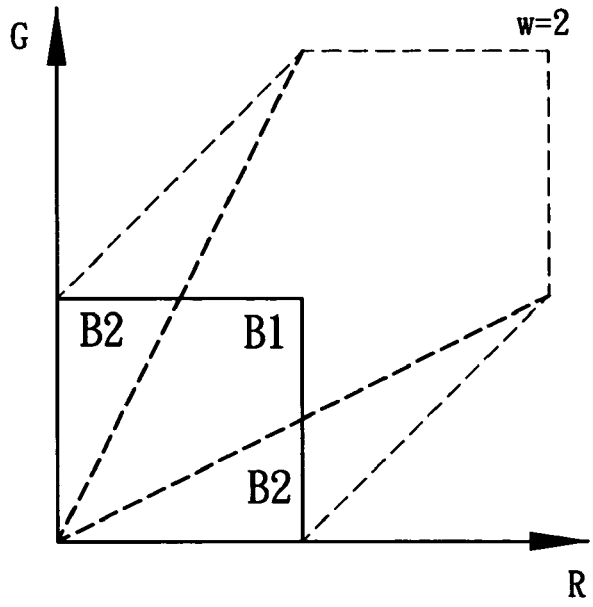
Fig. 8 PRIOR ART

FIG. 8 is the schematic diagram for the color space of the image-processing method proposed by the Samsung Company. (w=2)

Figure 9:
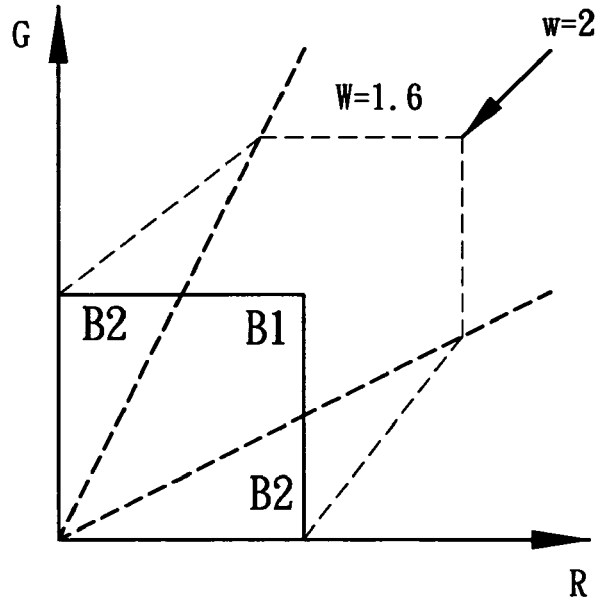
Fig. 9 PRIOR ART

FIG. 9 is the schematic diagram for the color space of the image-processing method proposed by the Samsung Company. (w=1.6)

Figure 10:
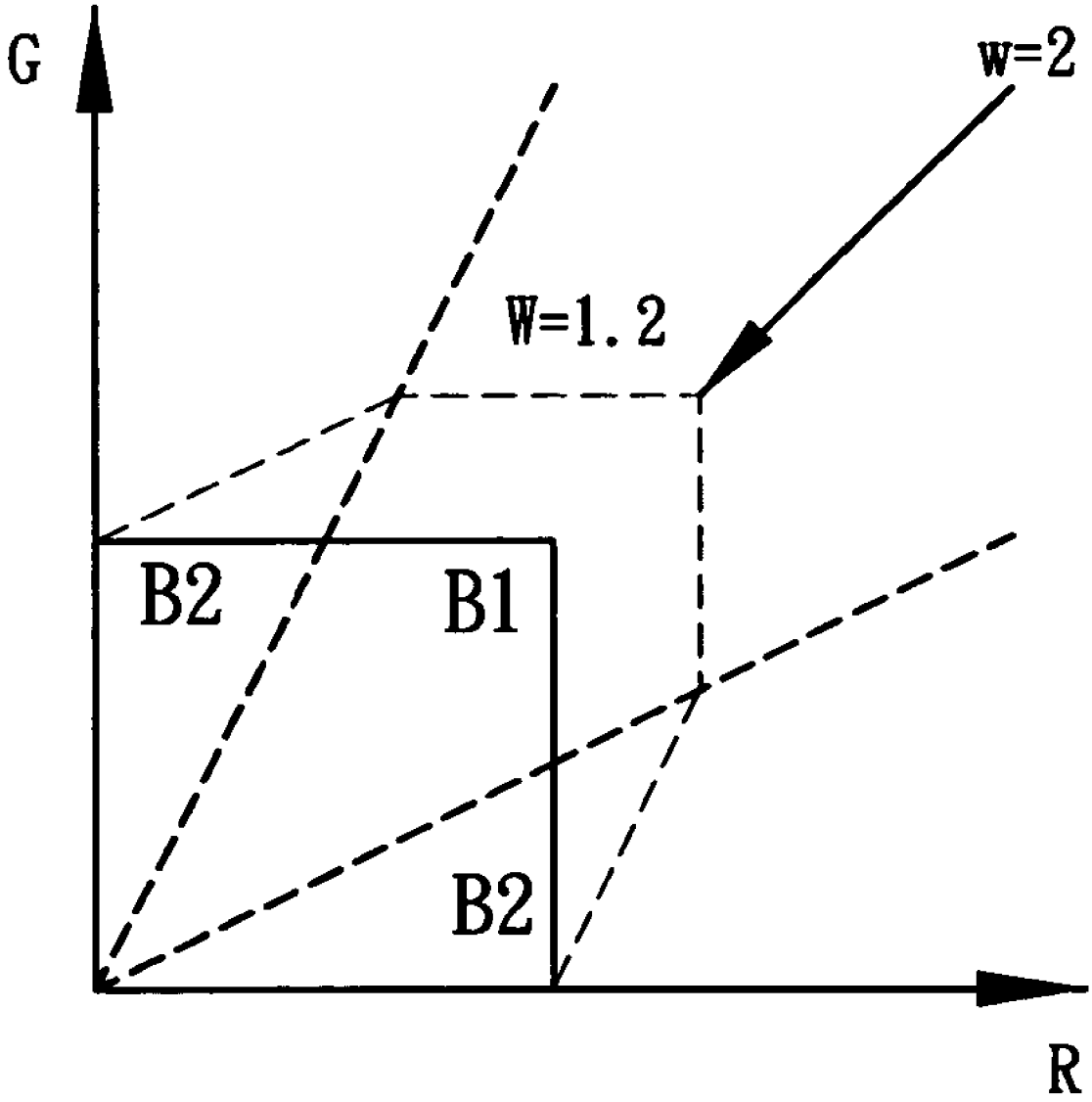
Fig. 10 PRIOR ART

FIG. 10 is the schematic diagram for the color space of the image-processing method proposed by the Samsung Company. (w=1.2)

Figure 11:
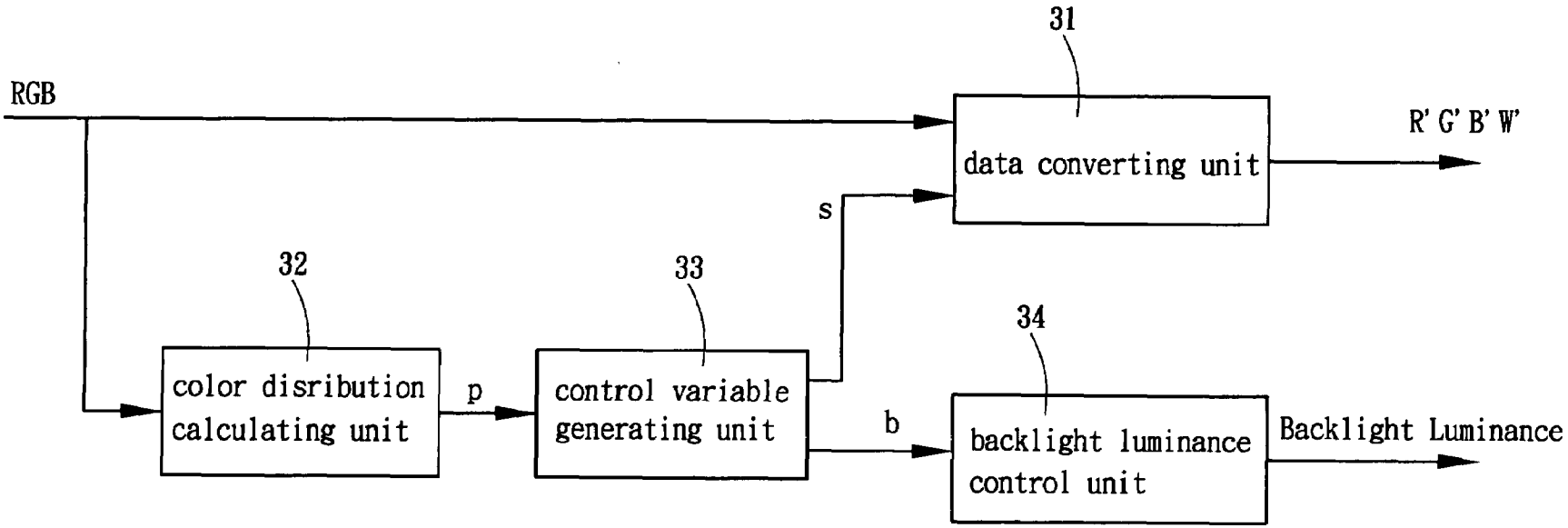

FIG. 11 is the schematic diagram for the image-processing method of the present invention.

Figure 12:
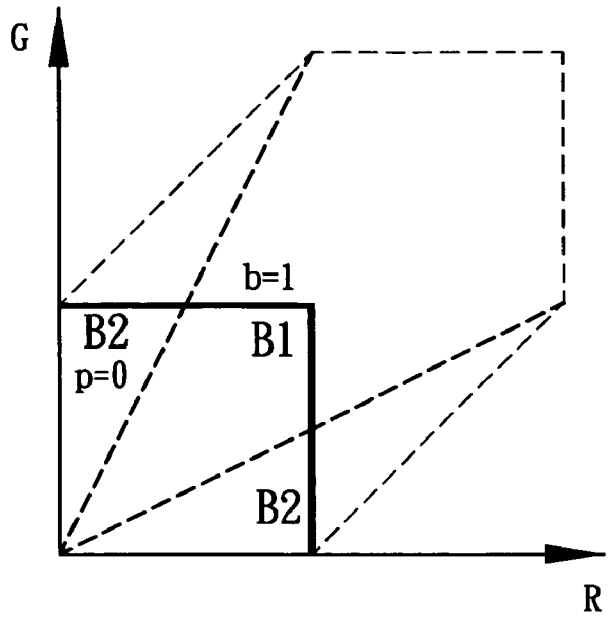

FIG. 12 is the schematic diagram for the color space of the present invention. (p=0, b=1)

Figure 13:
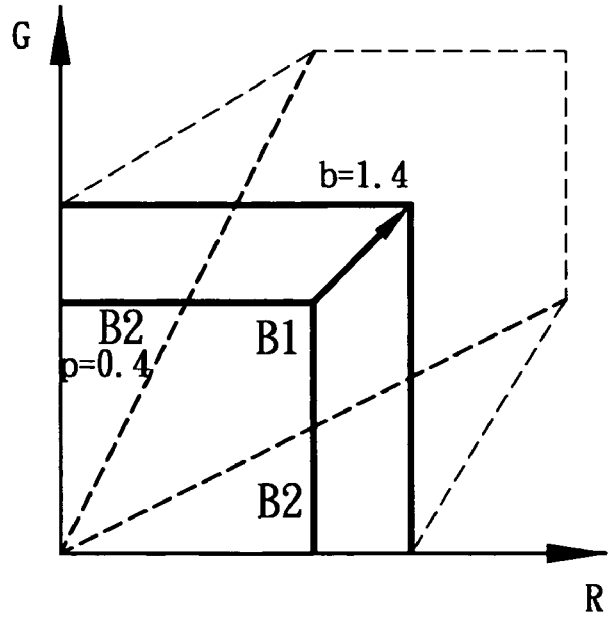

FIG. 13 is the schematic diagram for the color space of the present invention. (p=0.4, b=1.4)

Figure 14:
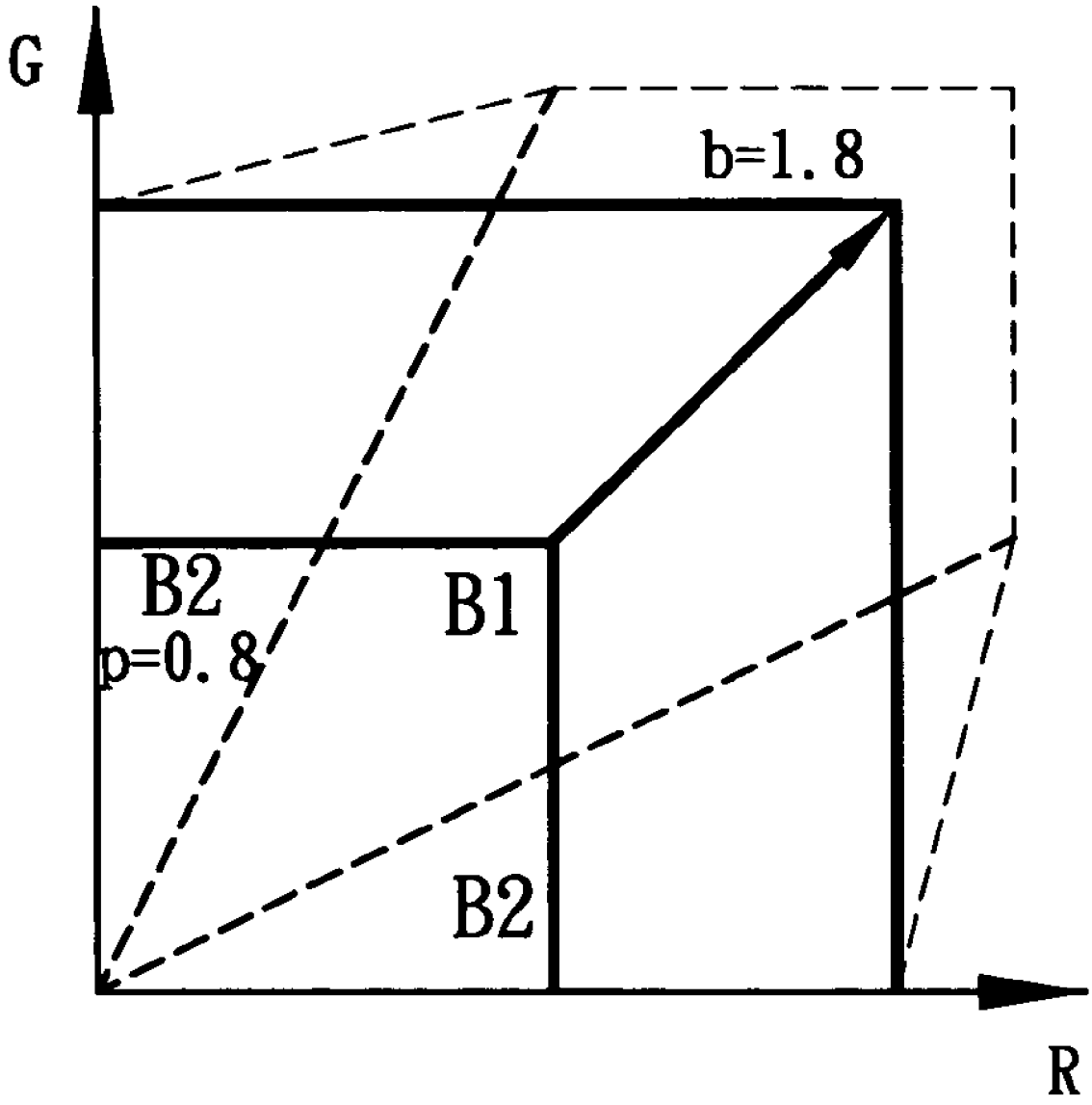

FIG. 14 is the schematic diagram for the color space of the present invention. (p=0.8, b=1.8)

DETAILED DESCRIPTION OF THE PREFERRED EMBODIMENTS

The detailed descriptions for contents and the technology of this invention associated with figures are as follows.

Please refer to FIG. 11, which is the schematic diagram for the image-processing method of the present invention. The color distribution-calculating unit 32 inputs the original image-color (RGB) data. The color distribution-calculating unit 32 classifies each pixel-color of the input image. According to the data relation among colors red (R), green (G), and blue (B), the relation of the colors located in the color space is divided into block B1 and block B2 (as shown in FIG. 12), and then calculates the ratio of the color data in any one of block B1 or block B2. (In the subsequent description, the ratio p ($1 \geqq p \geqq 0$) for calculating the input image-color in block B2 is used to illustrate the present invention.)

The data relation among colors red (R), green (G), and blue (B) in block B1 is: $\max(R,G,B)/\min(R,G,B) \leqq 2$, and the data relation among colors red (R), green (G), and blue (B) in block B2 is: $\max(R,G,B)/\min(R,G,B) > 2$. And then calculate the ratio p for whole input image-color (RGB) data in block B2, where p=(the pixel number of colors in the block B2)/(the total pixel number of the image).

The control-variable generating unit 33 that determines the value of the converting-control variable s and the value of the backlight luminance-control variable b according to the ratio p output by the color distribution calculating unit 32. The converting-control variable s will be output to the RGB-to-RGBW data-converting unit 31, and the backlight luminance-control variable b will be output to the backlight luminance-control unit 34. (The relation among the converting-control variable s, the backlight luminance-control variable b, and the ratio p could be: $b=p+1$; $s=2/(p+1)$, however, the relation is not restricted to this equation but can be adjusted according to properties of products.)

The data-converting unit 31 will input the original image-color (RGB) data and the converting-control variable s generated by the control-variable generating unit 33, the input data of image color R, G, and B are converted to the output data of image color R', G', B' and W' according to the converting-control variable s ($2 \geqq s \geqq 1$). If the colors of the image pixel are located in the block B1, then $$W'=\min(s\times R, s\times G, s\times B)$$

$$R'=s\times R-W'$$
$$G'=s\times G-W'$$
$$B'=s\times B-W'$$

If the colors of the image pixel are located in the block B2, then $$k=1+(s-1)\{\min(R,G,B)/[\max(R,G,B)-\min(R,G,B)]\}$$

$$W'=\min(k\times R, k\times G, k\times B)$$

$$R'=k\times R-W'$$
$$G'=k\times G-W'$$
$$B'=k\times B-W'$$

The image-color processed by this algorithm can preserve the original hues and saturation due to $R:G:B=(R'+W'):(G'+W'):(B'+W')$.

Moreover, the backlight luminance-control unit 34 controls the backlight luminance of the display panel according to the backlight luminance-control variable b ($2 \geqq b \geqq 1$). When b equals 1, the backlight luminance is kept at the original value; when b equals 2, the backlight luminance is increased to double of the original value.

Please refer to FIG. 12, which shows the color space can be displayed for when the ratio p for calculating the input image-color in block B2 equals 0 (p=0). According to the aforementioned equations ($b=p+1$; $s=2/(p+1)$), when the ratio p equals 0 the backlight luminance-control variable b equals 1 and the converting-control variable s equals 2, which represents that all colors of the input image are located in the block B1. Consequently, the backlight luminance retains the original value; the effect of double luminance is achieved.

Please refer to FIG. 13, which shows that the color space can be displayed for when the ratio p for calculating the input image-color in block B2 equals 0.4 (p=0.4). According to the aforementioned equations ($b=p+1$; $s=2/(p+1)$), when the ratio p equals 0.4, the backlight luminance-control variable b equals 1.4 and the converting-control variable s equals 1.43, which represents that 40% colors of the input image are located in the block B2. Consequently, the backlight luminance increases to 1.4 times of the original value; the extent of increasing luminance for image colors in block B2 is enhanced; the difference between the extents of increasing luminance for image colors in block B1 and in block B2 is reduced. Moreover, the effect of double luminance is still achieved.

Please refer to FIG. 14, which shows that the color space can be displayed for when the ratio p for calculating the input image-color in block B2 equals 0.8 (p=0.8). According to the aforementioned equations ($b=p+1$; $s=2/(p+1)$), when the ratio p equals 0.8,the backlight luminance-control variable b equals 1.8 and the converting-control variable s equals 1.11, which represents that 80% colors of the input image are located in the block B2. In other words, most colors of the input image are located in the block B2. Consequently, the backlight luminance increases to 1.8 times of the original value; the extent of increasing luminance for image colors in block B2 enhances substantially. The extent of increasing luminance for those high-luminance and high-saturation images in block B2 also can approximate to 2, and the extent of increasing luminance for image colors in block B1 still equals 2. Accordingly, the difference between the extents of increasing luminance for image colors in block B1 and in block B2 is efficiently reduced. By way of this, not only the effect of double luminance is still achieved but also the image-contrast quality can be preserved before and after the luminance enhancement. The phenomenon of too large variation of the simultaneous contrast before and after the luminance enhancement is efficiently restrained.

To sum up, comparing the image-processing device and method with the prior image-processing method, the present invention has the following merits:

1. The current invention can enhance the luminance of the displayed image color under the condition of retaining the hue and saturation of the original image.
2. The current invention can improve drawbacks of U.S. Pat. No. 6,724,934, and overcome the phenomenon of too large variation of the simultaneous contrast after the luminance enhancement for images so as to enhance the contrast quality and effect of the displayed image after the luminance enhancement. Especially when those images display high-luminance and high-saturation colors and high-luminance but tend to white color at the same time, the image quality is improved substantially.

Comparing the present invention to the paper 'Implementation of RGBW Color System in TFT-LCDs' proposed by the Samsung Company, the paper has to calculate the color-distortion value e before and after the luminance enhancement repeatedly so as to obtain the best luminance-enhancement gain w for the input image data. As a result, the method needs complicated and much investment of hardware and image calculation. On the other hand, the image-processing device and method proposed by the present invention calculates the data of colors red R, green G, and blue B of the input image only once so as to find out the ratio of the input image-color located in any block of block B1 or block B2 such that the RGB-to-RGBW data-converting processing can be completed. The present invention efficiently reduces the operation quantity of the image processing, and saves the investment for circuit hardware. Furthermore, without sacrificing the luminance enhancement, the image-display quality can still be preserved by this invention so as to achieve the goals of increasing luminance double, preserving hues and saturation of colors, and preserving the image-contrast quality concurrently.

What is claimed is:

1. An image-processing device for enhancing the luminance and the image quality of display panels, which is an RGBW color-system device for improving the optical efficiency of liquid-crystal displays, comprising:

a color distribution calculating unit that calculates an original image-color data and calculates a ratio of the color data in any one of block B1 or block B2, where a data relation among colors red (R), green (G), and blue (B) in block B1 is: max(R,G,B)/min(R,G,B)≦2, and where the data relation among colors red (R), green (G), and blue (B) in block B2 is: max(R,G,B)/min(R,G,B)>2; and a control-variable generating unit that inputs the ratio so as to determine a value of a converting-control variable and a value of a backlight luminance-control variable; and a data-converting unit that inputs the converting-control variable, and the data-converting unit converts the original image-color data to a new image-color data; and a backlight luminance-control unit that inputs the backlight luminance-control variable, and a backlight luminance-control unit controls the backlight luminance of a display panel.

2. An image-processing method for enhancing the luminance and the image quality of display panels, which is for improving the optical efficiency of liquid-crystal displays, comprising:

a color distribution calculating unit that calculates an original image-color data and calculates a ratio of the color data in any block of block B1 or block B2, where a data relation among colors red (R), green (G), and blue (B) in block B1 is: max(R,G,B)/min(R,G,B)≦2, and where the data relation among colors red (R), green (G), and blue (B) in block B2 is: max(R,G,B)/min(R,G,B)>2; and a control-variable generating unit determines the value of a converting-control variable and a value of a backlight luminance-control variable according to the ratio; and a data-converting unit converts the original image-color data to a new image-color data according to the converting-control variable; and a backlight luminance-control unit controls a backlight luminance of a display panel according to the input backlight luminance-control variable.

3. The image-processing method of claim 2, wherein the ratio value is the ratio for whole input image-color (RGB) data in block B2.

4. The image-processing method of claim 2, wherein a relationship between a converting-control variable s and a ratio p is $$s=2/(p+1),$$

where p is (the pixel number of colors in the block B2)/ (the total pixel number of the image).

5. The image-processing method of claim 4, wherein the equations for the data-converting unit to convert the original image-color data (RGB) to the new image-color data (R'G'B'W') according to the converting-control variable when the colors are located in the block B1 of the color space are $$W'=\min(s\times R,s\times G,s\times B);$$

$$R'=s\times R-W';$$

$$G'=s\times G-W';$$

$$B'=s\times B-W'.$$

6. The image-processing method of claim 4, wherein the equations for the data-converting unit to convert the original image-color data (RGB) to the new image-color data (R'B'W') according to the converting-control variable when the colors are located in the block B2 of the color space are $$k=1(s-1)\{\min(R,G,B)/[\max(R,G,B)-\min(R,G,B)]\};$$

$$W'=\min(k\times R,k\times G,k\times B);$$

$$R'=k\times R-W';$$

$$G'=k\times G-W';$$

$$B'=k\times B-W'.$$

* * * * *